United States Patent [19]

Lankton et al.

[11] Patent Number: 4,573,242

[45] Date of Patent: Mar. 4, 1986

[54] CLOSE PITCH HARNESSING DEVICE

[75] Inventors: Gordon B. Lankton, West Boylston; Joseph R. Paradis, Holden, both of Mass.

[73] Assignee: Nypro Inc., Clinton, Mass.

[21] Appl. No.: 533,353

[22] Filed: Sep. 19, 1983

[51] Int. Cl.[4] ..... B65D 63/00

[52] U.S. Cl. ..... 24/16 PB; 24/17 AP; 24/30.5 P

[58] Field of Search ..... 24/16 PB, 16 R, 20 TT, 24/17 AP, 30.5 P, 30.5 S, 30.5 L; 292/318, 319, 320, 321, 322; 248/74.3, 74.5

[56] References Cited

U.S. PATENT DOCUMENTS

| | | | |
|---|---|---|---|
| 1,871,064 | 8/1932 | Kipper et al. | 24/30.5 P |
| 2,904,294 | 9/1959 | Marygold | 24/16 PB |
| 3,494,002 | 2/1970 | Kabel | 24/16 PB |
| 3,721,750 | 3/1973 | Countryman | 24/16 PB |
| 3,766,608 | 10/1973 | Fay | 24/16 PB |
| 3,816,878 | 6/1974 | Fulton et al. | 24/16 PB |
| 3,991,444 | 11/1976 | Bailey | 24/16 PB |
| 4,001,898 | 1/1977 | Caveney | 24/16 PB |
| 4,045,843 | 9/1977 | Loose et al. | 24/16 PB |
| 4,137,606 | 2/1979 | Wood | 24/16 PB |
| 4,347,648 | 9/1982 | Dekkers | 24/16 PB |

FOREIGN PATENT DOCUMENTS

| | | | |
|---|---|---|---|
| 2139091 | 3/1972 | Fed. Rep. of Germany | 24/16 PB |
| 2063354 | 6/1981 | United Kingdom | 24/16 PB |

*Primary Examiner*—Victor N. Sakran
*Attorney, Agent, or Firm*—R. L. Nathans

[57] ABSTRACT

A harnessing device formed by a locking head and an attached, apertured and multi-section strap. The head contains a plurality of longitudinal guide channels for receiving adjoiningly connected longitudinal sections of the strap, after encirclement of the items to be harnessed. The head also contains a plurality of deflectable internal locking tangs, one for each section of the strap.

12 Claims, 8 Drawing Figures

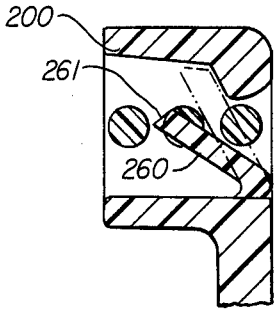
FIG. 4A
FIG. 4B
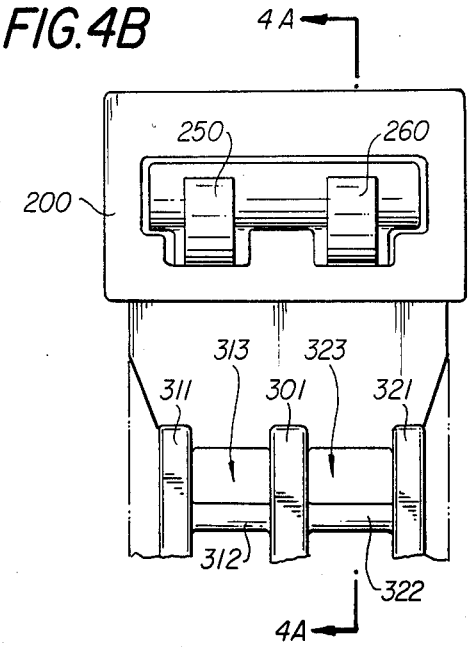

FIG.6A
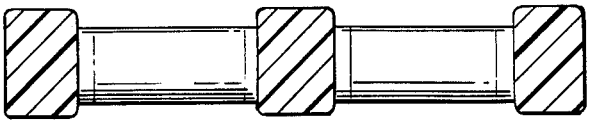
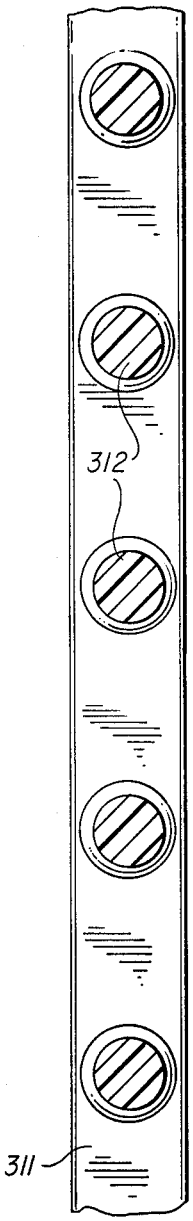
FIG.6B
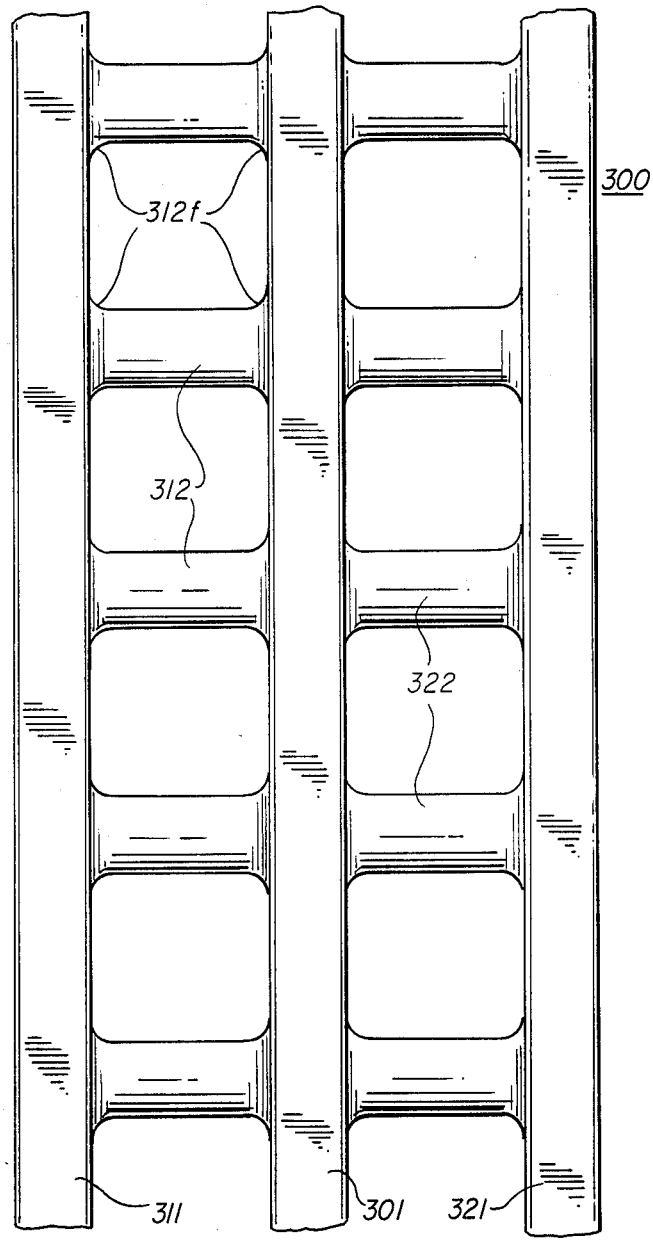
FIG.6C

CLOSE PITCH HARNESSING DEVICE

BACKGROUND OF THE INVENTION

This invention relates to the harnessing of items, and, more particularly, to the precision harnessing of items and prevention of accidental release.

Harnessing devices are widely used for the bundling of objects. Such devices are typically formed by a serrated strap fitted to an apertured head containing an internal pawl that engages the serrations of the strap; or by an apertured strap fitted to a buckle-like head, with a tongue that enters the apertures of the strap. Examples are U.S. Pat. Nos. 3,106,028; 3,189,961; 3,457,598 and 3,590,442.

Harnessing devices with searrated straps have the disadvantage of being only as secure as their pawls. Attempts have been made to strengthen serrated strap devices but this has resulted in considerable complexity without achieving the desired end result. Similar objections apply to harnessing devices with buckle-like heads. In these devices, a tongue which enters the strap apertures rests against the head of the buckle near its opening and is deflected by the strap. The tongue is typically a cantilever attachment to the buckle-like head, which tends to be undly stiff in the direction of forward thrust during harnessing, and insufficiently stiff in the direction of reverse thrust applied by the strap because of the harnessed item.

An alternative type of harnessing device is of the kind shown in U.S. Pat. No. 3,766,608 which issued Oct. 23, 1973. This harnessing device is formed by a locking head with an attached ladder strap. The latter is advantageously of stretch-orientable material and is elongated by stretching. This has the effect of increasing the separation of the rungs of the ladder. As a result the strap does not permit minute or close pitch adjustments. The required length of the head and the adjustability of the strap are governed by the distance of separation between adjoining rungs, which can be considerable when the strap has been stretched.

Accordingly, it is an object of the invention to achieve the secure and precision harnessing of items. A related object is to achieve secure and precision harnessing without the need for employing complex structural configurations.

A further object of the invention is to overcome the disadvantages associated with ladder strap harnessing devices, particularly those with stretched straps, while simultaneously retaining their advantage. A related object is to achieve minute, or close pitch adjustments in stretched strap harnessing devices. Another related object is to reduce the required length of head in stretched strap harnessing devices.

Another object of the invention is to avoid accidental harness release. A related object is to enhance the security of the members that are used to engage the straps of harnessing devices.

Still another object of the invention is to provide ease of harnessing and resistance to spontaneous unharnessing. A related object is to provide a head configuration that facilitates cinching of a harnessing strap, but, at the same time, impedes the tendency of tightly cinched straps to pull away from their heads.

A still further object of the invention is to limit the tendency of pawls or tongues of harnessing devices to accumulate excessive stresses at their points of engagement with harnessing straps.

Yet another object of the invention is to achieve a locking head and pawl which is particularly suitable for use with stretched straps in which close pitch adjustments are attainable. A related object is to achieve a desirable locking pawl for ladder straps with closely spaced rungs that are contacted by one or more pawls of a locking head.

SUMMARY OF THE INVENTION

In accomplishing the foregoing and related objects, the invention provides a harnessing device with a head having a plurality of longitudinally extending guide channels containing at least one locking tang. The locking tang desirably is confined within the head and mounted for pivotal movement with respect to one of the channels. The internal position of the locking tangs prevent external interferences and thus help prevent accidental release of the harnessed items.

In accordance with one aspect of the invention, there is a separate locking tang for each channel of the head. A multi-section apertured strap, desirably in the form of side-by-side ladder structures, is used to encircle the items to be harnessed. The strap extends from the locking head and is desirably perpendicular with respect to the longitudinal channels. The combination of the locking tangs with the multi-section apertured strap permits harnessing to take place without the objectionable stress concentration often found with other kinds of harnessing devices.

In accordance with another aspect of the invention, the side-by-side sections of the strap are separated from one another by longitudinally extending rails and the edges of the strap are bounded by similar longitudinally extending rails.

In accordance with a further aspect of the invention, the apertures of the strap are found between rungs which extend traversely with respect to the edges of the strap and are collinear from one section of the strap to another. However, the rungs can be non-collinear, and either be uniformly or non-uniformly distributed along the length of the strap.

In accordance with yet another aspect of the invention, the locking tangs are pivotable within the head and each locking tang has an end which is proportioned to engage the edge of the corresponding aperture in the strap. When the apertures are formed by the rungs of the ladder, the end of each locking tang is proportioned to engage a rung.

The head can contain a plurality of locking tangs which are positioned in separate channels on the same or opposite sides of the head.

DESCRIPTION OF THE DRAWINGS

Other aspects of the invention will become apparent after considering several illustrative embodiments, taken in conjunction with the drawings, in which:

FIG. 4A is a cross sectional view of a head for a harnessing device in accordance with the invention showing details of an illustrative locking tang;

FIG. 4B is a frontal view of the head of a harnessing device shown in cross section in FIG. 4A;

FIG. 6 is a plan view of a segment of the strap of FIG. 3 after stretching.

DETAILED DESCRIPTION

Figure 1:
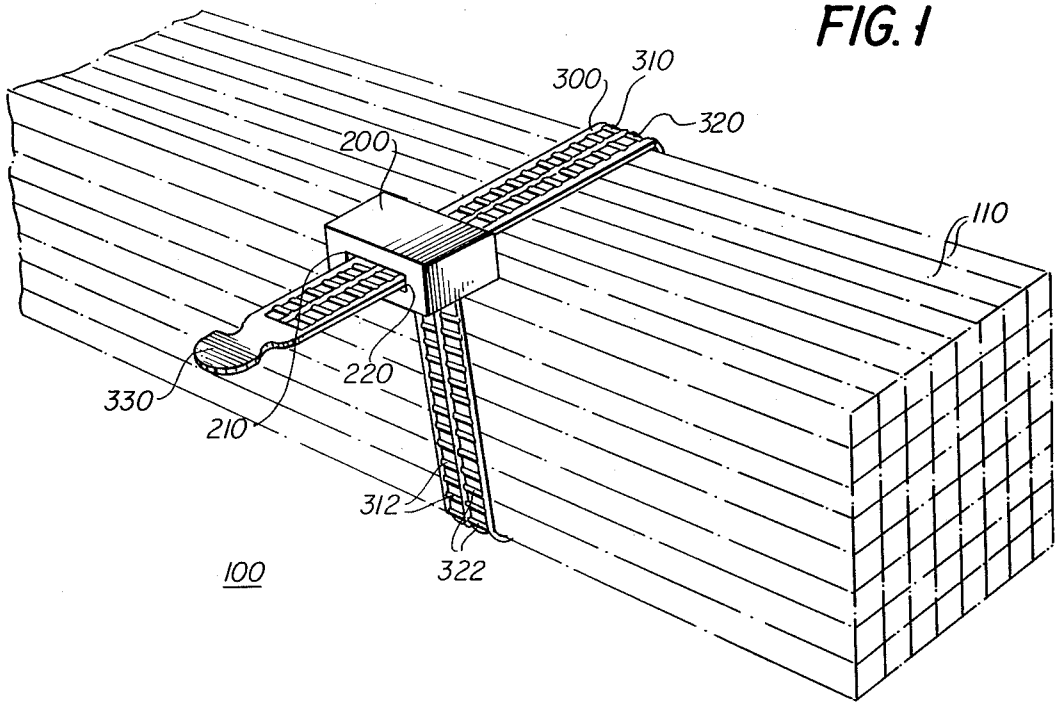
FIG. 1 is a perspective view of a harnessing device having multiple, side-by-side strap sections in accordance with the invention, being used to harness a bundle of items.

With reference to the drawings, FIG. 1 shows a harnessing device 100 in accordance with the invention formed by a locking head 200 with an attached strap 300. The strap 300 is in the form of a ladder structure with separate, side-by-side longitudinal sections 310 and 320. The sections 310 and 320 extend perpendicularly with respect to corresponding guide channels 210 and 220 in the head 200.

When a group of items 110 is to be harnessed, they are encircled by the strap 300 and a tab 330 at the free end of the strap is inserted into and through the guide channels 210 and 220. The strap 300 is drawn through the locking head by applying a forward thrust to it, and internal locking tangs (not shown in FIG. 1) are deflected in channels 210 and 220. The locking tangs engage successive rungs 312 of section 310 and 322 of section 320 until the items 110 are securely harnessed.

Reverse thrust produced on the strap 300 by the harnessed items 110 draws the locking tangs (not shown) against the rungs and keeps the items 110 from becoming unbundled. The device 100, including the head 200 and the strap 300 is desirably made out of a stretch reorientable elastomeric or plastic such as nylon or polypropylene.

Figure 2:
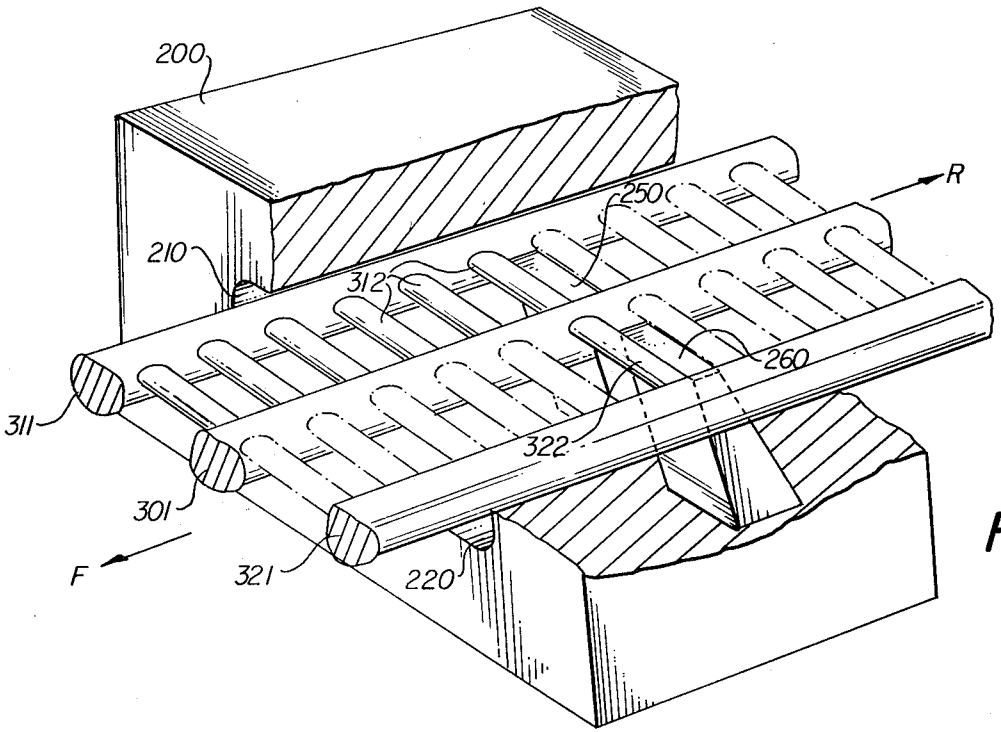
FIG. 2 is a perspective view of the head portion of the harnessing device of FIG. 1 with the upper part broken away to show the internal construction of the head in relation to the side-by-side strap sections.

The internal structure of the head 200 is shown in FIG. 2. The channels 210 and 220 also provide guides for the rails 311, 301 and 321 of the strap rungs 312 and 322. Extending into the guide channels 210 and 220 are respective locking tangs 250 and 260 which are pivotally mounted in their respective channels.

As shown in FIG. 2, each of the locking tangs 250 and 260 is in its equilibrium position after having been deflected by the forward motion of respective rungs 312 and 322. After the items 110 (FIG. 1) have become securely bundled and forward thrust F applied to the strap is terminated, the bundled items apply a reverse thrust through rungs 312 and 322 against tangs 250 and 260.

Figure 3:
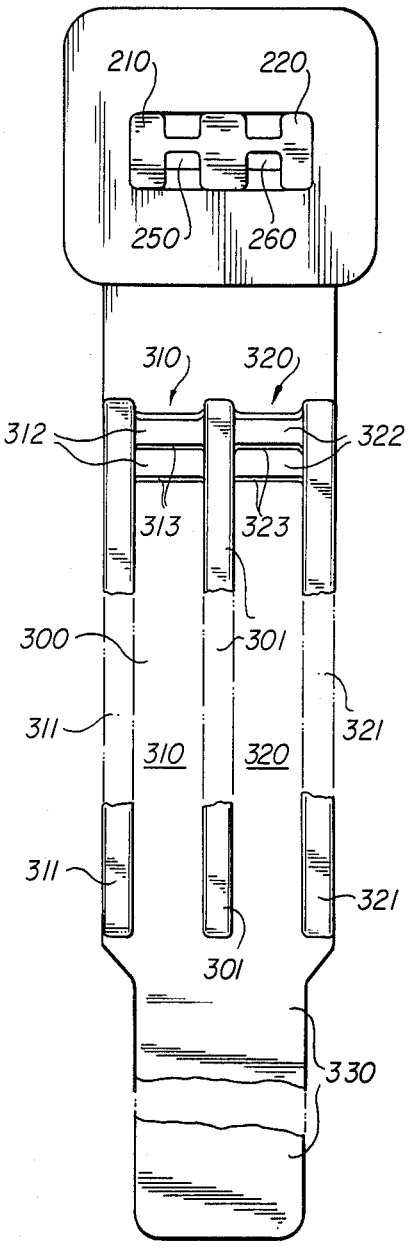
FIG. 3 is a plan view of a harnessing device in accordance with the invention having an attached, unstretched strap with an overall width exceeding the combined widths of the guide channel in the head.

A plan view of a harnessing device with an oversized strap 300 before stretching is shown in FIG. 3. This kind of strap is formed when the harnessing device is fabricated of a stretch-reorientable material, such as nylon, and the strap is thereafter stretched to produce the desired ladder configuration below the head shown in FIG. 4B.

Alternatively the strap 300 of FIG. 3 can be used without being pre-stretched when the harnessing device is fabricated of a stretchable elastomeric material. In that event, when the tab 330 is inserted into the guide channels 210 and 220, the strap become stretched over the items being harnessed by the forward thrust applied by the user. When the forward thrust is terminated, and the harnessed items exert a reverse thrust, there is resistance to that thrust by virtue of the locking tangs 250 and 260, but there is additional resistance to the reverse thrust by virtue of the contact of the side rails with the guide channels 210 and 220.

In the case of the strap 300 in FIG. 3 the rungs 312 are relatively closely spaced. A similar provision on spacing is made for the rungs 322 on the adjoining section 320. The close spacing is achievable by virtue of the inclusion of the central reinforcement rail 301 between the sections 310 and 320.

In an illustrative embodiment of the invention the strap 300 had a width of about 0.24 inches, with the first section 310 having a rung width of 0.66 inches and a similar rung width for the second section 320. It will be appreciated that the sections 310 and 320 may have unequal widths. In any event the interval of the rungs between the side rails 311 and 321 is on the order of 0.17 inches which would normally require a relatively wide separation of the successive rungs. In the case of the invention, however, the use of the intermediate reinforcement 301 permits successive rungs 312 and 322 to be separated, from center to center, on the order of 0.03 inches, with each rung having a representative diameter on the order of 0.025 inches.

After molding and stretching, the overall width of the strap 200' as shown in FIG. 4B, is reduced to 0.184 inches. The reinforcement and side rails 311, 301 and 321 are reduced from a width of about 0.036 inches to 0.024 inches. There is also a corresponding reduction in height from about 0.048 inches to about 0.032 inches.

In the usual case where there is stretching of a ladder strap, the only elongation that takes place is that of the side rails. In the present case however, because of the intermediate reinforcement rail 301, stretching produces a reduction in the width of the apertures 313 and 323 as well as an increase in aperture length. In addition, in the foregoing illustrative embodiment there was a small reduction in run diameters from about 0.0245 inches to about 0.0235 inches. There was also a reduction in rung width (per section) from about 0.066 inches to about 0.056 inches. The spacing between adjoining rungs was extended by the representative stretching operation from about 0.0305 inches to about 0.07 inches.

In the cross sectional view of FIG. 4A the pawl 260 is shown with an end 261 that is proportioned to engage the upper inner wall of the head 200. As noted above, the crucial determinent on the pitch of the adjoining rungs is the presence of the intermediate reinforcement rail 301 which allows a close pitch without the occurrence of sag in the rungs which would interfere with the secure engagement of the pawl 360 with the rungs 312.

A frontal view of the head 200 showing the relative positions of the pawls 250 and 260 is shown in FIG. 4B. As indicated both pawls 250 and 260 are on the same side of the head, which can be significantly reduced in the strap direction because of the relatively close pitch of the rungs provided by the invention. In the specific embodiment of FIG. 4B, the pawls 250 and 260 are rooted in that portion of the head adjoining the connection of the strap 300. It will be appreciated that the pawls 250 and 260 may be rooted on the opposite side of the head as well.

Figure 5A:
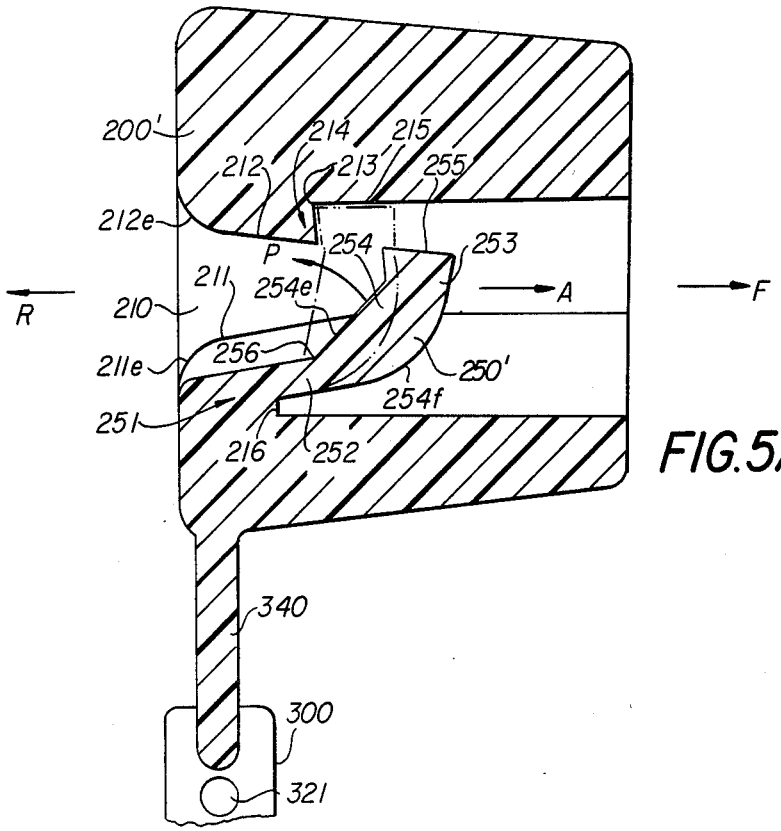
FIG. 5A is a cross sectional view of an alternative head for a harnessing device in accordance with the invention showing details of a locking tang and associated structure that are particularly suitable for the practice of the invention.

The pawl construction that is particularly suitable for the practice of the invention is shown in FIG. 5A. The head 200' of FIG. 5A is attached to the strap 300 by a tab 340 which, in its unstretched form, is approximately the same thickness as the diameter of each rung 321 or 322 of the strap 300.

The alternative head 200' contains a pair of pawls 250' and 260' of which only one of the pawls 250' is visible in FIG. 5A. The other pawl 260' is reversed in orientation. The specific relationship between the pawls 250' and 260' is more apparent from the frontal view of FIG. 5B.

Figure 5B:
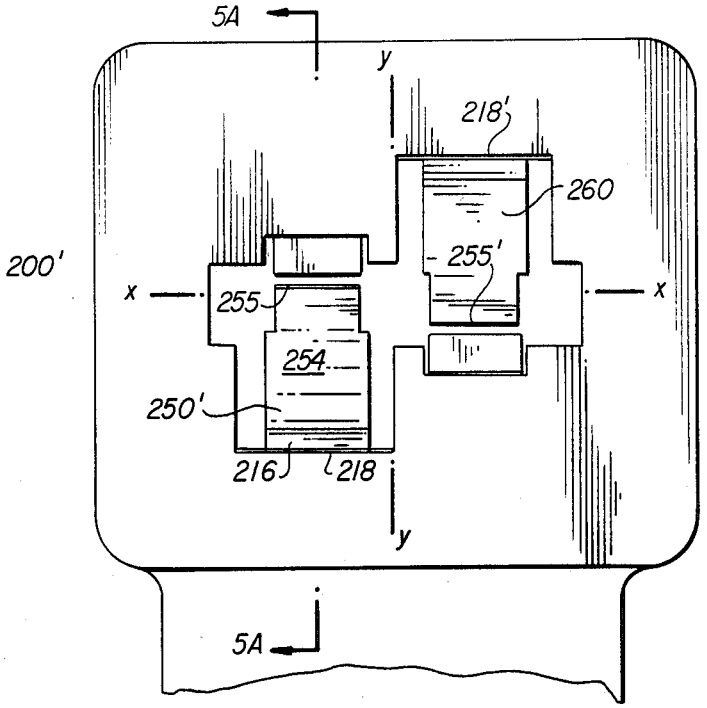
FIG. 5B is a frontal view of the head of FIG. 5A illustrating oppositely positioned, multiple pawls in accordance with the invention.

The head 200' includes a lower ledge 211 in the channel 210 associated with the pawl 250'. In addition, the channel 210 includes an upper ledge 212. As indicated in FIG. 5B both the ledges 211 and 212 have tapered and rounded entry portions 211*e* and 212*e* to facilitate the insertion of the strap 300 into the head 200'. The pawl 250' extends from a pedestal 251 to a neck 252 and then to a tang 253 which is proportioned to facilitate the deflection of the pawl 250' as the strap 300 is inserted into the head and then to facilitate locking engagement of the pawl 250' between adjoining rungs 311. In order to achieve secure harnessing the pawl 250' has an enlarged lower section 254 and a tip 255. When reverse thrust is applied to the strap 300 in the direction of the arrow R. in FIG. 5A, for example as a result of the weight of the items harnessed by the bundling strap, the pawl 250' is pivoted in the direction indicated by the arrow P about the pivot point 256 until the tip 255 becomes engaged in the notch 213 of the head tooth 214. In particular the lower portion of the engagement surface 254*e* of the shank 254 has a different curvature than the opposite surface 254*f*. The knee of the surface 254*f* lies at the intersection of of line parallel to the outer surfaces of the neck 252 and a perpendicular to the axis of insertion A. The engagement surface 254*e* is desirably in the form of a ramp that extends from the pivot position 256 to the first point of contact with a rung 311. The tip 255 is at an acute angle of elevation with respect to the axis A of insertion in order to achieve abutting contact with the adjoining notch surface 215 of the head 200' after reverse thrust has been applied and the pawl has been pivoted in a counterclockwise direction as indicated by the arrow P.

A frontal view of the head 200' is shown in FIG. 5B, viewing the head in the direction of the reverse thrust arrow R of FIG. 5A. As seen in FIG. 5B a vertical ledge 216 is located below the pivot point 256 such that there is, in addition to the counterclockwise rotation of the pawl, deformation of the neck 252 in order to enhance the secure locking of the strap in the harnessing position. Also indicated in FIG. 5B is the reduction in width of the pawl 250' below the tip 255 and above the shank 254. The double lines shown for the tip 255 as well as the respective lower and upper channel edges 218 and 219 indicate tapering to facilitate withdrawal of the mold parts during formation of the head 200'.

Also indicated in FIG. 5B is the converse position of the second pawl 260' relative to the first pawl 250'. The first pawl 250' extends upwardly from the lower channel surface 218, while the second pawl 260' depends downwardly from an upper channel wall 218' that is symmetrically disposed about axes X and Y in FIG. 5B.

It will be understood that although the pawls 250' and 260' of FIG. 5B have their tips 255 and 255' in lateral alignment so that they engage corresponding rungs on adjoining sections 310 and 320 of the strap 300, they may be longitudinally separated within the head to engage nonaligned rungs for straps with nonaligned or aligned sections.

An illustrative fragment of the strap 300 after stretching is shown in FIG. 6. The rungs 312 are proportioned relative to the rails 311, 301 and 321 so that stretching not only produces a reduced cross section of the rails but also of the rungs. The consequence, as illustrated in FIG. 6, is that the junction of each rung 312 with one of the rails 311, 301, or 321 is to produce a fillet 312*f*. In addition the use of the reinforcement rail 301 permits the use of individual rungs 312 which have smaller diameters than would be required in the absence of the reinforcement rail 301. As a result the same degree of stretching in a reinforced strap with smaller rungs, as compared with a non-reinforced strap having larger rungs, produces a closer pitch of the rungs and greater precision in the adjustment of the strap relative to the items being harnessed.

While various aspects of the invention have been set forth by the drawings and specification, it is to be understood that the foregoing detailed description is for illustration only and that various changes in parts, as well as the substitution of equivalent constituents for those shown and described may be made without departing from the spirit and scope of the invention as set forth in the appended claims.

What is claimed is:

1. A harnessing device comprising a head having a plurality of interconnected guide channels extending longitudinally therethrough;

a multi-section strap attached to said head with a separate section for each channel thereof;

a locking tang within said head, including a mid-section width which is thicker than opposed end portions, for each section of said strap; and an anchor included in said head and being lockingly engaged by the free end of said tang when said strap is under load and said tang forms an arch extending from said anchor position to the root position where said tang is integral with said head.

2. A harnessing device in accordance with claim 1 wherein the sections of said strap are separated from one another by an elevated longitudinally extending rail.

3. A harnessing device in accordance with claim 1 wherein the inside edges of said strap are bounded by a longitudinally stretched side rail.

4. A harnessing device in accordance with claim 1 wherein apertures in said straps are formed between rungs which extend transversely with respect to the length of said strap.

5. A harnessing device in accordance with claim 4 wherein said rungs are collinear and reduced in pitch from one section of said strap to another.

6. A harnessing device in accordance with claim 4 wherein said rungs are non-collinear from one section of said strap to another.

7. A harnessing device in accordance with claim 5 wherein the rungs are uniformly distributed along the length of the strap.

8. A harnessing device in accordance with claim 1 wherein said head contains a plurality of locking tangs which are positioned in laterally separate channels on the same side of said head.

9. A harnessing device in accordance with claim 1 wherein said head contains a plurality of laterally separated locking tangs which are positioned in separate channels on opposite sides of said head.

10. A harnessing device in accordance with claim 1 wherein the tangs engaged by said strap are on opposite sides thereof and form an interlock by extending through apertures in said strap.

11. A harnessing device in accordance with claim 1 wherein said strap has rungs and each locking tang has an engagement surface which is opposite a curved surface with a different curvature than said engagement surface.

12. A harnessing device in accordance with claim 1 wherein said strap has rungs and each locking tang has an engagement surface for a rung of said strap which extends discontinuously to a tip that abuts a notch of said head when said rung is engaged.

* * * * *